US008517910B2

(12) United States Patent
Rosenbom

(10) Patent No.: US 8,517,910 B2
(45) Date of Patent: Aug. 27, 2013

(54) METHOD OF DETERMINING A GAIN SETTING OF A BONE-ANCHORED HEARING AID

(75) Inventor: Tove Rosenbom, Smørum (DK)

(73) Assignee: Oticon Medical A/S, Smorum (DK)

( * ) Notice: Subject to any disclaimer, the term of this patent is extended or adjusted under 35 U.S.C. 154(b) by 420 days.

(21) Appl. No.: 12/880,866

(22) Filed: Sep. 13, 2010

(65) Prior Publication Data

US 2011/0071339 A1 Mar. 24, 2011

Related U.S. Application Data

(60) Provisional application No. 61/245,307, filed on Sep. 24, 2009.

(30) Foreign Application Priority Data

Sep. 24, 2009 (EP) ..... 09171256

(51) Int. Cl.
*H04R 1/10* (2006.01)

(52) U.S. Cl.
USPC ..... 600/25; 600/559; 381/60; 381/312

(58) Field of Classification Search
USPC ..... 600/25, 559; 381/312, 60
See application file for complete search history.

(56) References Cited

U.S. PATENT DOCUMENTS

| | | | | |
|---|---|---|---|---|
| 6,496,585 | B1 | 12/2002 | Margolis | |
| 2004/0097826 | A1 | 5/2004 | Harrison et al. | |
| 2007/0179398 | A1* | 8/2007 | Margolis | 600/559 |
| 2008/0253595 | A1* | 10/2008 | Steinbuss | 381/312 |

FOREIGN PATENT DOCUMENTS

| | | |
|---|---|---|
| GB | 553955 | 6/1943 |
| WO | WO 03/001846 A1 | 1/2003 |

OTHER PUBLICATIONS

Weber BA, Roush J, McElveen JT. Application of an Implantable Bone Conduction Hearing Device to Patients with Unilateral Sensorineural Hearing Loss. Laryngoscope, vol. 102, May 1, 1992, pp. 538-542.*

Harvey Dillon, "Binaural and Bilateral Considerations in Hearing Aid Fitting", Chapter 14, In: Hearing Aids, Jan. 19, 2001, Thieme, USA, XP002565887, pp. 370-403.

(Continued)

*Primary Examiner* — Christine Matthews
*Assistant Examiner* — Joshua D Lannu
(74) *Attorney, Agent, or Firm* — Birch, Stewart, Kolasch & Birch, LLP

(57) ABSTRACT

The invention regards a method for determining a gain setting of a bone-anchored hearing aid comprising a bone anchor, the proximal and the distal ears having respective first and second monaural bone-conduction hearing thresholds, the first monaural bone-conduction hearing threshold being higher than the second monaural bone-conduction hearing threshold. The method comprises: obtaining respective first and second measured monaural bone-conduction hearing thresholds for the proximal and the distal ear; and determining the gain setting in dependence on the first and the second measured monaural bone-conduction hearing thresholds.

The execution of the method does not require obtaining other hearing thresholds than such that are typically determined or measured anyway during the diagnostic phase. Still, using both the first and the second measured monaural bone-conduction hearing thresholds as a basis for determining the gain setting allows the hearing aid to avoid producing undesirably high sound levels in the good ear, even when the individual has asymmetric monaural bone-conduction hearing thresholds.

12 Claims, 3 Drawing Sheets

(56) References Cited

OTHER PUBLICATIONS

Harvey Dillon, "CROS, Bone-Conduction, and Implanted Hearing Aids", Chapter 16, In: Hearing Aids, Jan. 19, 2001, Thieme, USA, XP002565888, pp. 434-450.

Michael Valente, "Fitting Options For Unilateral Hearing Loss", The Hearing Journal, Laux Co., Harvard, MA, US, vol. 48, No. 4, Apr. 1, 1995 pp. 10, 45-48, XP009008733.

Nolan et al., "Transcranial attenuation in bone conduction audiometry", The Journal of Laryngology and Otology, Ashford, GB, vol. 95, Jun. 1981, pp. 597-608, XP009113693.

Richard Usifer, "Just what is a CROS system?" Hearing Instruments, Harcourt Brace Jovanovich Publ. Duluth, Minnesota, US, vol. 46, No. 12, Dec. 1, 1995, p. 14, XP000628030.

Roy F. Sullivan, "Transcranial ITE CROS", Hearing Instruments, Harcourt Brace Jovanovich Publ., Duluth, Minnesota, US, vol. 39, No. 1, Jan. 1, 1998, pp. 11-12 and 14, XP009008789.

Weber et al., "Application of an Implantable Bone Conduction Hearing Device to Patients With Unilateral Sensorineural Hearing Loss", Laryngoscope, [Online] vol. 102, May 1, 1992, pp. 538-542, XP002565886.

* cited by examiner

METHOD OF DETERMINING A GAIN SETTING OF A BONE-ANCHORED HEARING AID

CROSS REFERENCE TO RELATED APPLICATIONS

This nonprovisional application claims the benefit of U.S. Provisional Application No. 61/245,307 filed on Sep. 24, 2009 and to Patent Application No. 09171256.2 filed in the European Patent Office on Sep. 24, 2009, all of which are hereby expressly incorporated by reference into the present application.

TECHNICAL FIELD

The present invention relates to a method of determining a gain setting of a bone-anchored hearing aid and to a system adapted to determine a gain setting of a bone-anchored hearing aid. More specifically, the present invention relates to a method of determining a gain setting of a bone-anchored hearing aid intended for use by an individual with asymmetric monaural bone-conduction hearing thresholds and to a system adapted to execute the method.

The invention may e.g. be useful in applications such as prescribing and/or fitting bone-anchored hearing aids to hearing-impaired individuals and in systems for fitting bone-anchored hearing aids to the particular needs of hearing-impaired individuals.

BACKGROUND ART

Patent Specification GB 553,955 discloses a bone-anchored hearing aid comprising a microphone, an amplifier, a magnet with a coil, and a ferromagnetic armature, hereafter referred to as "bone anchor". The bone anchor is implanted in the bone structure of a hearing-impaired individual's head. The amplifier amplifies the microphone output signal and drives the coil with the amplified signal. The coil cooperates with the magnet and the ferromagnetic properties of the bone anchor to induce vibrations into the bone structure. The vibrations propagate from the bone anchor to the cochlea of the aided ear mainly through the bone structure.

Bone-anchored hearing aids like the one described above may be used by individuals having asymmetric monaural bone-conduction hearing thresholds, i.e. a substantially higher monaural bone-conduction hearing threshold on one ear (the "bad" ear) than on the other (the "good" ear). In this case it is known to locate the bone anchor and the microphone of the hearing aid close to the bad ear in order to improve the individual's abilities to hear with the bad ear and to hear sounds originating on the bad-ear side of the head.

In order to provide a satisfactory compensation of the hearing loss, all hearing aids, including bone-anchored hearing aids, must be fitted to the particular needs of the hearing-impaired individual. An important part of the fitting process is to specify how the hearing aid shall control the amplifier gain. Hearing aids typically execute various signal processing algorithms, which modify the amplifier gain dynamically, e.g. in order to compress received sounds or adapt to changing listening environments. Most hearing aids control the amplifier gain in dependence on a gain setting. The gain setting typically defines the amplifier gain to be used in a specific listening situation and for received sound signals with a specific level. The gain setting thus functions as a basis for the dynamic control. The gain setting is typically determined early in the fitting process, but may be adjusted further during subsequent portions of the fitting process, e.g. in order to compensate for individual preferences and/or for deviations from theoretical values initially relied upon.

Prior to prescribing a hearing aid, the type, the severeness and the cause of the hearing loss are usually investigated in an initial diagnostic phase. A typical task in the diagnostic phase is to measure monaural bone-conduction hearing thresholds. The measurement is performed individually for each of the individual's ears. Usually, a test signal is emitted by means of a test vibrator, which is temporarily held against the skin just behind the ear to be measured. The test vibrator induces vibrations through the skin and tissue into the bone structure, through which they propagate to the cochlea of the ear to be measured. The thresholds are obtained by varying the level and the frequency of the test signal and recording for each frequency, at which level the individual is just able to hear the test signal. In order to improve the diagnosis of the hearing loss and its causes, an airborne masking noise may be emitted into the respective other ear, so that the test signal is only audible in the ear closest to the test vibrator.

Bone-anchored hearing aids have hitherto typically been fitted to the bad ear of an individual by determining a gain setting for the hearing aid's amplifier in dependence on measured monaural bone-conduction hearing thresholds for the bad ear. However, induced vibrations intended for the bad ear propagate to the good ear as well, and it is a known problem that a bone-anchored hearing aid may produce undesirably high sound levels in the good ear after being fitted to the bad ear of an individual with asymmetric monaural bone-conduction hearing thresholds.

A known remedy for the above mentioned problem is to determine the gain setting in dependence on measured binaural bone-conduction hearing thresholds, i.e. hearing thresholds measured for both ears simultaneously. Binaural bone-conduction hearing thresholds are typically measured by inducing a test signal, i.e. vibrations, at different levels into the bone structure and recording the lower one of the levels at which the individual is able to hear the test signal in at least one of the ears. The test signal is typically induced directly into the bone structure by means of the implanted bone anchor of the hearing aid itself. However, measuring binaural bone-conduction hearing thresholds is time-consuming, both for the person performing the fitting, i.e. the hearing-care professional, and for the hearing-impaired individual, and since such measurements are typically not performed in the diagnostic phase, this remedy adds to the cost and inconvenience associated with fitting a bone-anchored hearing aid.

There is therefore a need for a method of determining a gain setting of a bone-anchored hearing aid, which method remedies the above mentioned problem without requiring the hearing-care professional to perform additional measurements. It is an object of the present invention to provide such a method.

It is a further object of the present invention to provide a system, which is adapted to determine a gain setting of a bone-anchored hearing aid.

DISCLOSURE OF THE INVENTION

Objects of the invention are achieved by the invention described in the accompanying claims and as described in the following.

An object of the invention is achieved by a method of determining a gain setting for each of at least two different frequency bands of a bone-anchored hearing aid comprising an element, which for each said frequency band has a gain influencing an output level of the hearing aid, and a bone anchor, which is implanted in the bone-structure of an individual at a laterally asymmetrical implantation location thereby defining a proximal ear and a distal ear of the individual, the proximal and the distal ear having respective first and second monaural bone-conduction hearing curves, the first monaural bone-conduction hearing curve being higher than the second monaural bone-conduction hearing curve, and the hearing aid being adapted to control each said gain in dependence on the corresponding gain setting. The method comprises for each said frequency band: obtaining respective first and second measured monaural bone-conduction hearing thresholds for the proximal and the distal ear; estimating in dependence on the first and the second measured monaural bone-conduction hearing thresholds whether the proximal ear or the distal ear has the lower implant-specific bone-conduction hearing threshold, thereby defining a more sensitive ear; determining the first gain setting in dependence on the measured monaural bone-conduction hearing threshold for the more sensitive ear; and transmitting the first gain setting to the hearing aid.

The method does not require obtaining other hearing thresholds than such that are typically determined or measured anyway during the diagnostic phase. Still, using both the first and the second measured monaural bone-conduction hearing thresholds as a basis for determining the gain setting may allow the hearing aid to avoid producing undesirably high sound levels in the good ear, even when the individual has asymmetric monaural bone-conduction hearing thresholds. It may further allow for compensating for frequency-dependent levels of and/or differences between the first and second measured monaural bone-conduction hearing thresholds.

Preferably, the method further comprises: estimating for the proximal and the distal ear respective first and second implant-specific bone-conduction hearing thresholds in dependence on the first and the second measured monaural bone-conduction hearing thresholds; and defining the more sensitive ear by comparing the first and second implant-specific bone-conduction hearing thresholds.

Preferably, the method further comprises estimating transcranial attenuation between the implantation location and the cochlea of the distal ear. This may allow for obtaining an improved control of the gain, especially at higher signal frequencies.

Preferably, estimating transcranial attenuation comprises selecting a standard attenuation value. This may allow for a fast and easy determination of the transcranial attenuation.

Preferably, obtaining at least one of the first and the second measured monaural bone-conduction hearing thresholds comprises determining the respective threshold in dependence on previously recorded diagnostic data. This may allow for automatic computation of the hearing thresholds.

Preferably, obtaining at least one of the first and the second measured monaural bone-conduction hearing thresholds comprises: inducing vibrations with different levels into the bone structure of the individual's head close to the corresponding ear; and determining a lower one of the levels at which the individual is able to hear the vibrations. This may allow for obtaining more precise and/or updated hearing thresholds as well as for obtaining an improved control of the gain.

Preferably, obtaining at least one of the first and second measured monaural bone-conduction hearing thresholds further comprises emitting an airborne acoustic masking signal into the respective other ear. This may allow for obtaining even more precise hearing thresholds, thus improving the diagnosis of the hearing loss and its causes, and for obtaining an improved control of the gain.

A further object of the invention is achieved by a system adapted to determine a gain setting for each of at least two different frequency bands of a bone-anchored hearing aid comprising an element, which for each said frequency band has a gain influencing an output level of the hearing aid, and a bone anchor, which is implanted in the bone-structure of an individual at a laterally asymmetrical implantation location thereby defining a proximal ear and a distal ear of the individual, the proximal and the distal ear having respective first and second monaural bone-conduction hearing curves, the first monaural bone-conduction hearing curve being higher than the second monaural bone-conduction hearing curve, the hearing aid being adapted to control each said gain in dependence on the corresponding gain setting. The system is further adapted to for each said frequency band: obtain respective first and second measured monaural bone-conduction hearing thresholds for the proximal and the distal ear; estimate in dependence on the first and the second measured monaural bone-conduction hearing thresholds whether the proximal ear or the distal ear has the lower implant-specific bone-conduction hearing threshold, thereby defining a more sensitive ear; determine the first gain setting in dependence on the measured monaural bone-conduction hearing threshold for the more sensitive ear; and transmit the first gain setting to the hearing aid.

Using the system does not require obtaining other hearing thresholds than such that are typically determined or measured anyway during the diagnostic phase. Still, using both the first and the second measured monaural bone-conduction hearing thresholds as a basis for determining the gain setting may allow the hearing aid to avoid producing undesirably high sound levels in the good ear, even when the individual has asymmetric monaural bone-conduction hearing thresholds. It may further allow for compensating for frequency-dependent levels of and/or differences between the first and second measured monaural bone-conduction hearing thresholds.

Preferably, the system is further adapted to: estimate for the proximal and the distal ear respective first and second implant-specific bone-conduction hearing thresholds in dependence on the first and the second measured monaural bone-conduction hearing thresholds; and define the more sensitive ear by comparing the first and second implant-specific bone-conduction hearing thresholds.

Preferably, the system is further adapted to estimate transcranial attenuation between the implantation location and the cochlea of the distal ear. This may allow for obtaining an improved control of the gain, especially for higher signal frequencies.

Preferably, the system is further adapted to estimate transcranial attenuation by selecting a standard attenuation value. This may allow for a fast and easy determination of the transcranial attenuation.

Preferably, the system is further adapted to obtain at least one of the first and the second measured monaural bone-conduction hearing thresholds by determining the respective threshold in dependence on previously recorded diagnostic data. This may allow for automatic computation of the hearing thresholds.

It is intended that the structural features of the system described above, in the detailed description of 'mode(s) for carrying out the invention' and in the claims can be combined with the methods, when appropriately substituted by a corresponding process. Embodiments of the methods have the same advantages as the corresponding systems.

Further objects of the invention are achieved by the embodiments defined in the dependent claims and in the detailed description of the invention.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. Furthermore, such a "connection" or "coupling" may be realised as wired or wireless using any commonly known electronic method of connecting or coupling elements. As used herein, the term "and/or" includes any and all combinations of one or more of the associated listed items. The individual operations and/or steps of any method disclosed herein do not have to be performed in the exact order disclosed, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals and/or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

In the present context, the term "bone-conduction hearing threshold" refers to a hearing threshold for sound signals or vibrations received through the bone structure, whereas the term "airborne hearing threshold" refers to a hearing threshold for airborne sound signals received through the outer ear. The terms are related in that an airborne hearing threshold for a particular ear depends on a corresponding bone-conduction hearing threshold for the same ear. The term "threshold" refers to a threshold for a single frequency or a single frequency band, unless expressly stated otherwise. The term "corresponding threshold" refers to a threshold for the same frequency as a previously mentioned threshold, level or frequency band. The term "uncomfortable level" refers to a level above which sounds will be perceived as uncomfortably loud. Furthermore, the term "normal" applied to a hearing threshold or a level refers to statistical mean values of the respective hearing threshold or level for normal-hearing individuals, i.e. individuals not suffering from a hearing loss. The term "monaural bone-conduction hearing threshold" refers to a hearing threshold for a particular ear for vibration signals induced into the bone structure close to the particular ear. The term "implant-specific bone-conduction hearing threshold" refers to a hearing threshold for a particular ear for vibration signals induced into the bone structure at the implantation location of the bone anchor.

Figure 1:
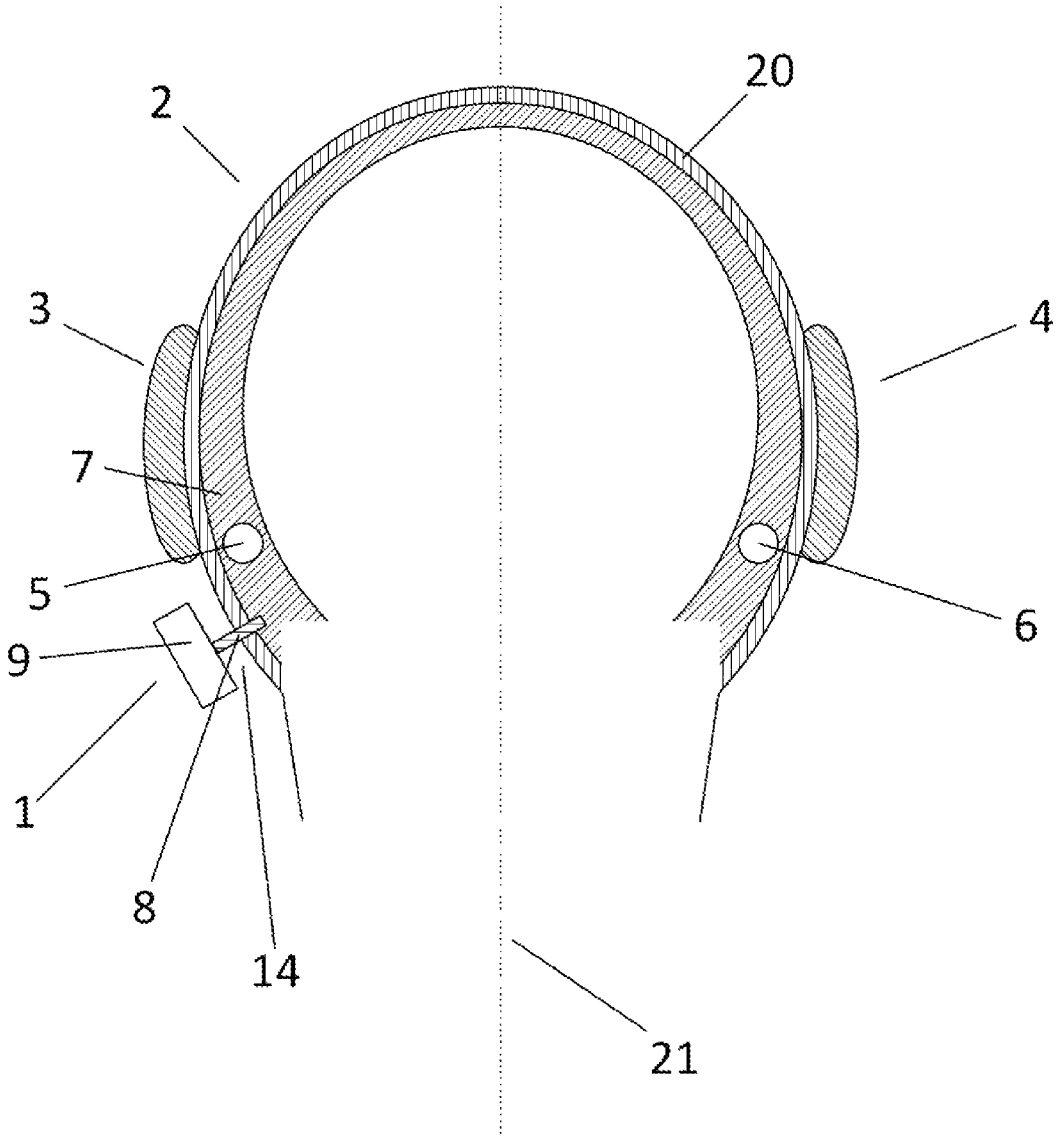
FIG. 1 shows an example mounting of a bone-anchored hearing aid on an individual's head.

FIG. 1 shows an example mounting of a bone-anchored hearing aid 1 on an individual's head 2. The head is viewed from behind. The figure also shows the left ear 3 and the right ear 4, the respective cochleae 5, 6 and the bone structure 7 of the cranium. The hearing aid 1 comprises a bone anchor 8, which is anchored in the bone structure 7 at an implantation location 14 close to and behind the left ear 3, and a signal processing unit 9, which is detachably mounted on a protruding portion of the bone anchor 8. The implantation location 14 is asymmetric with respect to the lateral plane 21 of the individual and thus defines a proximal ear 3, i.e. the ear 3 located on the same side of the lateral plane 21 as the bone anchor, and a distal ear 4, i.e. the ear 4 located on the other side. The proximal cochlea 5 and the distal cochlea 6 are defined in the same way. In the shown example, the left ear 3 and the left cochlea 5 are thus proximal, whereas the right ear 4 and the right cochlea 6 are distal.

Figure 2:
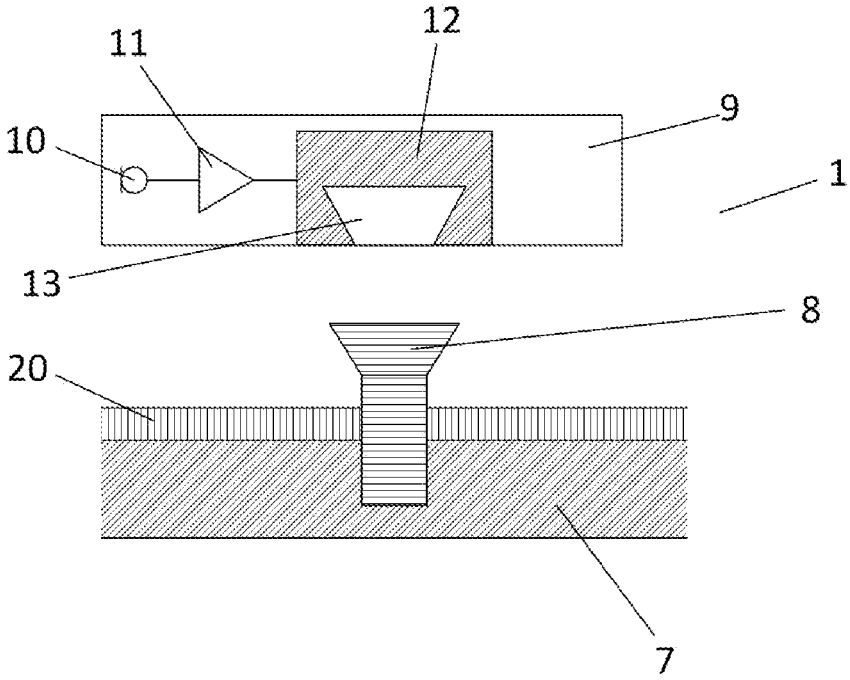
FIG. 2 shows details of the bone-anchored hearing aid in FIG. 1.

As shown in FIG. 2, the signal processing unit 9 comprises a microphone 10, an amplifier 11 and a vibrator 12. The gain of the amplifier 11 is adjustable individually for each of six frequency bands. The vibrator 12 has a coupling 13 for detachably mounting the signal processing unit 9 on the bone anchor 8. The bone anchor 8 is implanted in the bone structure 7, and a portion of the bone anchor 8 protrudes through the skin and tissue 20. The shown configuration of the bone-anchored hearing aid 1 is well known in the art. The signal processing unit 9 may comprise further elements or circuits, such as a microcontroller, digital and/or analog filters, feedback cancelling means and other signal processing means as is also well known in the art.

The microphone 10 receives sound signals from the environment of the individual. The amplifier 11 amplifies the microphone output signal and drives the vibrator 12 with the amplified signal. The vibrator 12 emits corresponding vibrations to the bone anchor 8 via the coupling 13 and thus to the bone structure 7. The vibrations propagate to the cochleae 5, 6 mainly through the bone structure 7. The vibrations reach the proximal, left cochlea 5 substantially without attenuation, whereas the longer path to the distal, right cochlea 6 causes a transcranial attenuation A4, A5 (see FIG. 3) of the vibrations, mainly at frequencies above 1 kHz and increasing with increasing frequency. Thus, the distal, right cochlea 6 receives at least the high frequency portion of the vibrations at a lower level than the proximal, left cochlea 5.

Figure 3:
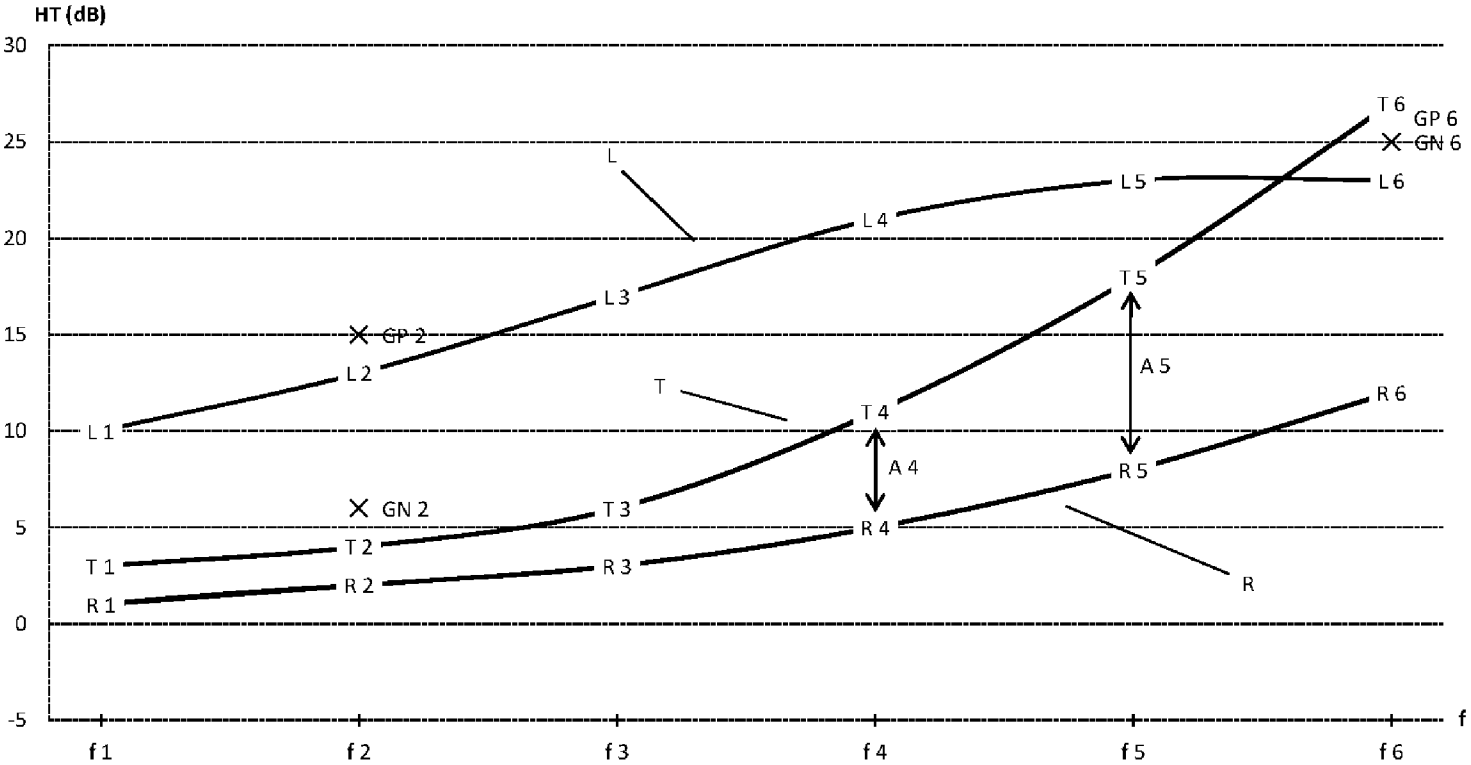
FIG. 3 shows an example of measured monaural bone-conduction hearing thresholds for an individual with asymmetric monaural bone-conduction hearing thresholds.

FIG. 3 shows example monaural bone-conduction hearing thresholds L1-L6, R1-R6 for an individual with asymmetric monaural bone-conduction hearing thresholds. All thresholds are shown in dB relative to the normal monaural bone-conduction hearing thresholds and on a logarithmic frequency scale. The hearing thresholds L1-L6 for the left ear 3 are connected with a left-ear hearing curve L. The hearing thresholds R1-R6 for the right ear 4 are connected with a right-ear hearing curve R. Each hearing curve L, R comprises hearing thresholds L1-L6, R1-R6 measured at six test frequencies f1-f6, which may be e.g. 250 Hz, 500 Hz, 1 kHz, 2 kHz, 4 kHz and 8 kHz.

The fact that the left-ear hearing curve L is above the right-ear hearing curve R, indicates that the individual has a more severe bone-conduction hearing loss on the left ear 3 than on the right ear 4.

FIG. 3 further shows example transcranial hearing thresholds T1-T6, i.e. bone-conduction hearing thresholds for the right ear 4 for vibrations induced into the bone structure 7 close to the left ear 3. Since, in the shown example, the bone anchor 8 is implanted close to the left ear 3, the transcranial hearing thresholds T1-T6 are substantially equal to the implant-specific bone-conduction hearing thresholds for the right ear 4. A transcranial hearing curve T connects the transcranial hearing thresholds T1-T6. Two differences between the transcranial hearing thresholds T1-T6 and the respective monaural bone-conduction hearing thresholds R1-R6 for the right ear 4 are indicated with arrows A4, A5. The differences A4, A5 are substantially equal to the transcranial attenuation at the respective frequencies.

In the example shown in the figures, it is desired that the bone-anchored hearing aid 1 compensate for a hearing loss in the proximal ear 3 of the individual. In this case, it is typically an initial goal of fitting the bone-anchored hearing aid 1 to set the gains for the individual frequency bands of the hearing aid amplifier 11 so that the aided hearing thresholds match those of normal-hearing individuals. In other words, the gains should be set so that sounds received by the microphone 10 at levels equalling the normal airborne hearing thresholds are reproduced at the proximal cochlea 5 as vibrations having levels equalling the corresponding monaural bone-conduction hearing thresholds L1-L6 of the individual for the proximal ear 3. These initial values of the gains are stored as gain settings in the hearing aid 1. The actual gains in the hearing aid 1 will, however, typically deviate from the gain settings, due to signal processing algorithms, which modify the gains, e.g. in order to compress received sounds or adapt to the listening environment.

For simplicity, it is in the following assumed that the centre frequencies of the frequency bands equal the test frequencies f1-f6, that the normal airborne hearing threshold equals 0 dB, that the normal monaural bone-conduction hearing threshold equals 0 dB, and that a frequency band gain of 0 dB corresponds to an initial fitting as described above for an individual having normal monaural bone-conduction hearing thresholds. Using other centre frequencies for the frequency bands than the test frequencies f1-f6, and/or using other reference levels than those stated above for the thresholds and/or the gains is within the scope of the invention, and it should be a manageable task for a skilled person to compensate for the use of such other centre frequencies and/or such other reference levels.

The invention and its advantages over the prior art are explained with reference to FIG. 3 and to two example airborne signals. The first airborne signal is a pure tone with a frequency equalling the test frequency f2. The second airborne signal is a pure tone with a frequency equalling the test frequency f6. Each of the airborne signals is received by the microphone 10 at a level of 2 dB, i.e. slightly above the corresponding normal airborne hearing thresholds. The hearing aid 1 converts the airborne signals into vibration signals, which it induces into the bone structure 7.

First, the prior-art method is explained. The gain setting for the frequency band at f2 is initially set equal to the monaural bone-conduction hearing threshold L2 for the proximal ear 3. The first airborne signal is accordingly converted into a first vibration signal, indicated in FIG. 3 by the marker GP2, with a level of L2+2 dB. The level of the first vibration signal GP2 is thus slightly above the monaural bone-conduction hearing threshold L2, and the individual is just able to hear the first vibration signal GP2 in the left ear 3. The level of the first vibration signal GP2 is, however, well above the transcranial hearing threshold T2, and the individual is not only able to hear the first vibration signal GP2 in the right ear 4, but also perceives it as distinctively louder in the right ear 4 than the in the left ear 3. Furthermore, the individual perceives the first vibration signal GP2 as distinctively louder than the first airborne signal would be perceived in a normal-hearing ear, which is highly undesired.

Similarly, the gain for the frequency band at f6 is set equal to the monaural bone-conduction hearing threshold L6, and the second airborne signal is accordingly converted into a second vibration signal, indicated in FIG. 3 by the marker GP6, with a level of L6+2 dB. The level of the second vibration signal GP6 is thus slightly above the monaural bone-conduction hearing threshold L6, and the individual is just able to hear the first vibration signal in the left ear 3. The level of the second vibration signal GP6 is below the transcranial hearing threshold T6, and the individual is not able to hear the second vibration signal GP6 in the right ear 4.

The cited prior-art method of determining a gain setting thus produces the desired level for the second airborne signal, but causes the first airborne signal to be perceived undesirably loud by the individual.

Second, an embodiment of the method of the present invention is explained. Each of the gain settings is initially set equal to the lower one of the corresponding implant-specific bone-conduction threshold for the left ear 3 and the corresponding implant-specific bone-conduction threshold for the right ear 4. As explained further above, the monaural bone-conduction hearing thresholds L1-L6 for the left ear 3 is a good estimate for the implant-specific bone-conduction thresholds for the left ear 3, and the transcranial hearing thresholds T1-T6 for the right ear 4 is a good estimate for the implant-specific bone-conduction thresholds for the right ear 4. Estimating which of the proximal ear 3 and the distal ear 4 has the lower implant-specific bone-conduction thresholds effectively defines a more sensitive ear. The gain setting for the frequency band at f2 is initially set equal to the corresponding implant-specific bone-conduction hearing threshold for the more sensitive ear 3, 4, which in this case is the right ear 4. The gain setting is thus set equal to T2. The first airborne signal is accordingly converted into a third vibration signal, indicated in FIG. 3 by the marker GN2, with a level of T2+2 dB. The level of the third vibration signal GN2 is below the monaural bone-conduction hearing threshold L2, and the individual is not able to hear the third vibration signal GN2 in the left ear 3. The level of the third vibration signal GN2 is, however, slightly above the transcranial hearing threshold T2, and the individual is just able to hear the third vibration signal GN2 in the right ear 4.

Similarly, the gain setting for the frequency band at f6 is initially set equal to the corresponding implant-specific bone-conduction hearing threshold for the more sensitive ear 3, 4, which in this case is the left ear 3. The gain setting is thus set equal to L6. The second airborne signal is accordingly converted into a fourth vibration signal, indicated in FIG. 3 by the marker GN6, with a level of L6+2 dB. The fourth vibration signal GN6 coincides with the second vibration signal GP6. The level of the fourth vibration signal GN6 is thus slightly above the monaural bone-conduction hearing threshold L6, and the individual is just able to hear the fourth vibration signal GN6 in the left ear 3. The level of the fourth vibration signal GN6 is below the transcranial hearing threshold T6, and the individual is not able to hear the fourth vibration signal GN6 in the right ear 4.

The method of determining a gain setting according to the present invention thus allows for producing the desired vibration levels, both for the first and for the second airborne signal. A drawback of the method is that the perception of the airborne signal may shift from one ear to another, depending on the individual's actual hearing thresholds L1-L6, R1-R6. This drawback is, however, typically less annoying to the user of the hearing aid 1 than incorrect levels.

Figure 4:
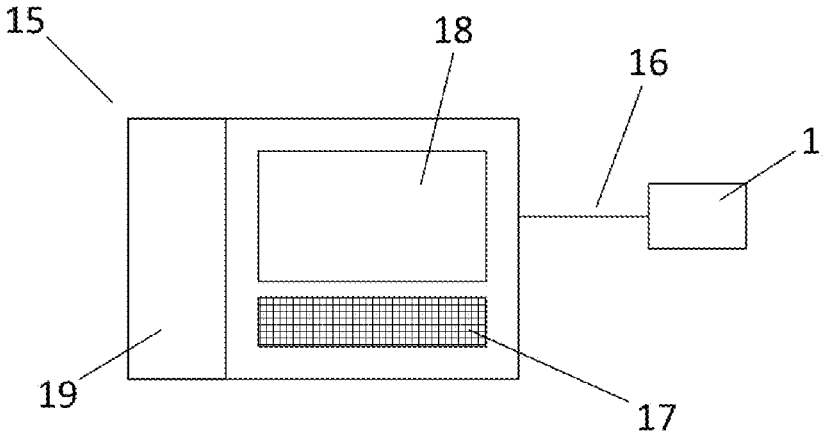
FIG. 4 shows an embodiment of a fitting system according to the invention.

FIG. 4 shows an embodiment of a fitting system 15 according to a further aspect of the invention. The fitting system 15 is connected to a bone-anchored hearing aid 1 via a wired adapter 16. Alternatively, the connection may be wireless. The fitting system 15 comprises a keyboard 17 for entering commands and data, a display 18 for showing data and a storage unit 19 for storing programs and data. The fitting system 15 is adapted to execute programs stored in the storage unit 19. A program stored in the storage unit 19 comprises instructions allowing the fitting system 15 to perform portions of the method according to the present invention, thereby facilitating execution of the method.

The fitting system 15 obtains measured monaural bone-conduction hearing thresholds L1-L6, R1-R6 for each of the individual's ears 3, 4 in one of several ways as chosen by the user of the fitting system 15, i.e. the hearing-care professional. The fitting system is adapted to assist the user in making measurements of the thresholds L1-L6, R1-R6, to allow the user to enter data manually and/or to read previously recorded data from a computer-readable medium. Such data may originate from the fitting system 15 itself or from another system (not shown). The fitting system 15 determines gain settings for each of the ears 3, 4 from the measured monaural bone-conduction hearing thresholds L1-L6, R1-R6. The gain settings are transmitted to the hearing aid 1, which stores them in a memory (not shown) and controls the gains in dependence on the stored gain settings.

Executing the method according to the present invention involves performing a number of computations. However, the computations themselves and the order of the computations may be varied in numerous ways without departing from the scope of the invention. For instance, it is not necessary to compute implant-specific bone-conduction hearing thresholds L2-L6, T1-T6 in order to define the more sensitive ear 3, 4. Instead, gain settings may e.g. be computed for each of the ears 3, 4, and the selection of the more sensitive ear 3, 4 may be determined by determining, which of the computed gain settings is lower. The skilled person should be readily able to contemplate other ways to arrive at the same gain settings.

The gain or gains to be controlled by the hearing aid 1 in dependence on the determined gain setting or gain settings may be any gain in the microphone 10, the amplifier 11, the vibrator 12, a filter and/or any suitable further elements comprised in the signal processing unit 9, provided that the gain influences the output level of the hearing aid 1.

Emitting a masking noise into the distal ear 4 during measurement of a monaural bone-conduction hearing threshold L1-L6, R1-R6 for the proximal ear 3 is not necessary for executing the method according to the present invention, but it may improve the control of the gain and further improve the diagnosis of the hearing loss and its causes.

The monaural bone-conduction hearing thresholds L1-L6, R1-R6 may be determined or computed from diagnostic data, which have been recorded manually or automatic, e.g. on a computer-readable medium, during any previous session, e.g. during the diagnostic phase. In the simple case, the recorded diagnostic data may comprise the monaural bone-conduction hearing thresholds L1-L6, R1-R6. Alternatively, the data may comprise information from which the hearing thresholds L1-L6, R1-R6 may be determined.

The transcranial attenuation A4, A5 may be determined from measurements on the individual. Alternatively, the transcranial attenuation A4, A5 may be determined from standard values derived from theoretical models and/or from statistical data.

Ideally, sounds received by the microphone 10 at a level equalling the normal uncomfortable level should be reproduced at the corresponding cochlea 5, 6 as vibrations having a level equalling the uncomfortable level for the respective ear 3, 4 of the individual. Since the difference between a hearing threshold L1-L6, R1-R6 and the corresponding uncomfortable level is typically decreased for a hearing-impaired individual, the hearing aid 1 may comprise means for compressing received sounds in order to compensate for this effect. Furthermore, the hearing aid 1 may continuously increase or decrease the gain in order to adapt to the current listening situation. At start-up of the hearing aid 1, the gain may be set equal to the stored gain setting, and subsequently, the gain may be continuously increased or decreased as described.

The method according to the present invention may be applied to determine a single gain setting, e.g. for the entire frequency range of the hearing aid 1, or alternatively, to determine a multitude of gain settings, e.g. six gain settings, each being intended for controlling the amplification of a specific frequency band. The method may be applied to all or to a subset of such gain settings.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims. For example, the features of the described embodiments may be combined arbitrarily.

The invention claimed is:

1. A method implemented on a computer for determining a gain setting for each of at least two different frequency bands of a bone-anchored hearing aid comprising an element, which for each said frequency band has a gain influencing an output level of the hearing aid, and a bone anchor, which is implanted in a bone structure of an individual at a laterally asymmetrical implantation location thereby defining a proximal ear and a distal ear of the individual, the proximal and the distal ear having respective first and second monaural bone-conduction hearing curves, the first monaural bone-conduction hearing curve being higher than the second monaural bone-conduction hearing curve, and the hearing aid being adapted to control the gain of each said frequency band in dependence on a corresponding gain setting, the method comprising for each said frequency band:

obtaining respective first and second measured monaural bone-conduction hearing thresholds for the proximal and the distal ear;

estimating with a processing unit in dependence on the first and the second measured monaural bone-conduction hearing thresholds whether the proximal ear or the distal ear has a lower implant-specific bone-conduction hearing threshold, thereby defining a more sensitive ear;

calculating with said processing unit the corresponding gain setting based on the measured monaural bone-conduction hearing threshold for the more sensitive ear;

estimating transcranial attenuation between the implantation location and the cochlea of the distal ear; and transmitting with a communication adapter the corresponding gain setting to the hearing aid.

2. A method according to claim 1, the method further comprising:

estimating for the proximal and the distal ear respective first and second implant-specific bone-conduction hearing thresholds in dependence on the first and the second measured monaural bone-conduction hearing thresholds; and defining the more sensitive ear by comparing the first and second implant-specific bone-conduction hearing thresholds.

3. A method according to claim 1, wherein the estimating the transcranial attenuation comprises selecting a standard attenuation value.

4. A method according to claim 1, wherein obtaining at least one of the first and the second measured monaural bone-conduction hearing thresholds comprises determining the at least one of the first and second measured monaural bone-conduction hearing thresholds in dependence on previously recorded diagnostic data.

5. A method according to claim 1, wherein obtaining at least one of the first and the second measured monaural bone-conduction hearing thresholds comprises:

inducing vibrations with different levels into the bone structure of the individual's head close to a corresponding ear; and determining a lower one of the different levels at which the individual is able to hear the vibrations.

6. A method according to claim 5, wherein obtaining at least one of the first and second measured monaural bone-conduction hearing thresholds further comprises emitting an airborne acoustic masking signal into a respective other ear.

7. A method according to claim 1, wherein said calculating with said processing unit includes setting the corresponding gain equal to the lower implant-specific bone-conduction hearing threshold for the more sensitive ear.

8. A system adapted to determine a gain setting for each of at least two different frequency bands of a bone-anchored hearing aid comprising an element, which for each said frequency band has a gain influencing an output level of the hearing aid, and a bone anchor, configured to be implanted in a bone structure of an individual at a laterally asymmetrical implantation location thereby defining a proximal ear and a distal ear of the individual, the proximal and the distal ear having respective first and second monaural bone-conduction hearing curves, the first monaural bone-conduction hearing curve being higher than the second monaural bone-conduction hearing curve, the hearing aid being adapted to control each said gain in dependence on the corresponding gain setting, the system comprising:

a processing unit that is adapted for each said frequency band to obtain respective first and second measured monaural bone-conduction hearing thresholds for the proximal and the distal ear;

estimate in dependence on the first and the second measured monaural bone-conduction hearing thresholds whether the proximal ear or the distal ear has a lower implant-specific bone-conduction hearing threshold, thereby defining a more sensitive ear;

calculate the corresponding gain setting based on the measured monaural bone-conduction hearing threshold for the more sensitive ear;

estimate transcranial attenuation between the implantation location and the cochlea of the distal ear; and a communication adapter configured to transmit the corresponding gain setting to the hearing aid.

9. A system according to claim 8, the system further being adapted to:

estimate for the proximal and the distal ear respective first and second implant-specific bone-conduction hearing thresholds in dependence on the first and the second measured monaural bone-conduction hearing thresholds; and define the more sensitive ear by comparing the first and second implant-specific bone-conduction hearing thresholds.

10. A system according to claim 8, wherein the processing unit estimates the transcranial attenuation by selecting a standard attenuation value.

11. A system according to claim 8, the system further being adapted to obtain at least one of the first and the second measured monaural bone-conduction hearing thresholds by determining the at least one of the first and second measured monaural bone-conduction hearing thresholds in dependence on previously recorded diagnostic data.

12. A system according to claim 8, wherein said processing unit is further configured to set the corresponding gain equal to the lower implant-specific bone-conduction hearing threshold for the more sensitive ear.

* * * * *